US005683086A

United States Patent [19]

Druckman et al.

[11] Patent Number: 5,683,086

[45] Date of Patent: Nov. 4, 1997

[54] SCULPTURE PUZZLE

[76] Inventors: Gil Druckman, 10 Pattai, 69973 Tel Aviv; Dan Hershkovitz, 1 Maale Hashachar, Ramat Gan, both of Israel

[21] Appl. No.: 677,657

[22] Filed: Jul. 8, 1996

Related U.S. Application Data

[63] Continuation-in-part of Ser. No. 593,198, Jan. 29, 1996, abandoned.

[51] Int. Cl.[6] ..... A63F 9/08

[52] U.S. Cl. ..... 273/156; 273/157 R

[58] Field of Search ..... 273/153 R, 155, 273/156, 157 R, 160; 446/117

[56] References Cited

U.S. PATENT DOCUMENTS

| | | | |
|---|---|---|---|
| 423,066 | 3/1890 | Massey | 446/117 |
| 702,615 | 6/1902 | Barden | 273/157 R |
| 752,377 | 2/1904 | Crittenden | 273/156 |
| 2,475,306 | 7/1949 | Beder | 273/157 R |
| 2,493,697 | 1/1950 | Raczkowski | 273/157 R |
| 2,725,234 | 11/1955 | Coble et al. | 273/157 R |
| 3,564,757 | 2/1971 | Fields | 446/117 |
| 3,779,558 | 12/1973 | Moreau | 273/157 R |

*Primary Examiner*—Steven B. Wong

*Attorney, Agent, or Firm*—Mark M. Friedman

[57] ABSTRACT

A sculpture puzzle which includes a base and a core which is attached to, and extends from, the base. The sculpture puzzle is constructed by sequentially mounting a number of planar segments to form a three dimensional figure.

30 Claims, 7 Drawing Sheets

SCULPTURE PUZZLE

This is a continuation-in-part of U.S. patent application Ser. No. 08/593,198, filed Jan. 29, 1996 now abandoned.

FIELD AND BACKGROUND OF THE INVENTION

The present invention relates to puzzles and, more particularly, to puzzles which can be used to form three-dimensional figures, or statues.

An almost virtually endless variety of puzzles are known. Perhaps the best known are the many varieties of jigsaw puzzles wherein the objective is to fit together a number of segments in the proper manner so as to form a coherent picture or image.

SUMMARY OF THE INVENTION

The present invention is of a puzzle which, when properly assembled through the correct sequential addition of individual segments, forms a three-dimensional figure, such as a sculpture or statue. For convenience and for ease of presentation, the system and method of the present invention is referred to in the specification and claims as a 'sculpture puzzle', it being understood that the present invention need not necessarily form a sculpture but may form any three-dimensional figure, nor is it necessary that the system be used as a puzzle.

According to the present invention there is provided a sculpture puzzle, comprising: (a) a base assembly; (b) at least one main core member having a top end and a bottom end, the bottom end being associated with the base assembly; and (c) a plurality of substantially planar segments formed with an opening therethrough for slidably accommodating the at least one main core member, the segments forming a three dimensional figure when mounted in a proper order onto the at least one main core member through the top end of the at least one main core member.

Also according to the present invention there is provided a method for creating a three dimensional figure, comprising the steps of: (a) providing: (i) a base assembly; (ii) at least one main core member having a top end and a bottom end, the bottom end being associated with the base assembly; and (iii) a plurality of substantially planar segments formed with an opening therethrough for slidably accommodating the at least one main core member; and (b) mounting the segments in a proper order onto the at least one main core member through the top end of the at least one main core member so as to form the three dimensional figure.

The present invention discloses a novel puzzle which calls for the user to create a three dimensional figure through the proper sequential mounting of planar segments having openings onto a core.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a sculpture puzzle and a method for its use which creates three-dimensional figures through the insertion in proper sequence of a number of planar segments onto a core member.

The principles and operation of a sculpture puzzle according to the present invention may be better understood with reference to the drawings and the accompanying description.

Figure 1:
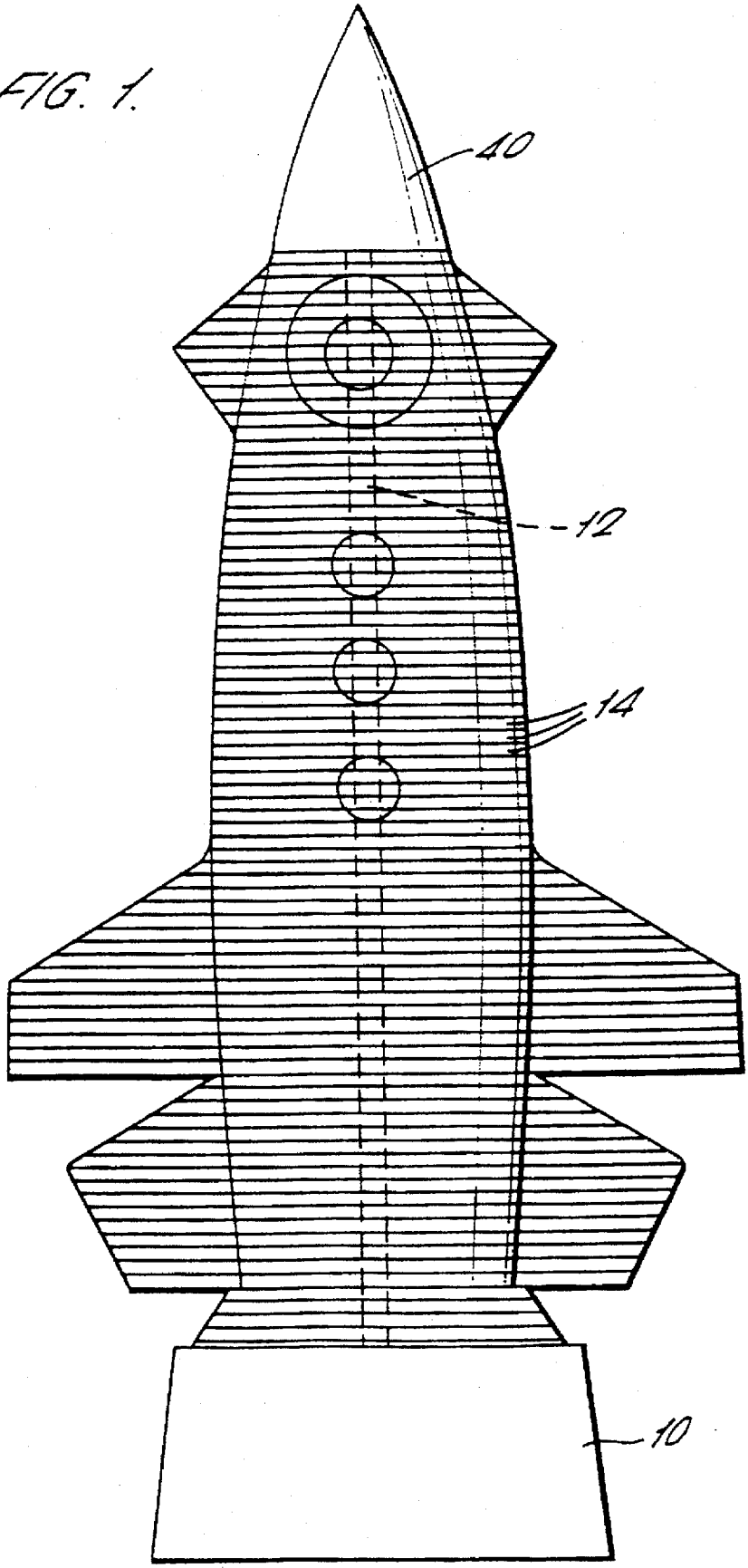
FIG. 1 shows one example of a completed sculpture puzzle according to the present invention.
Figure 2:
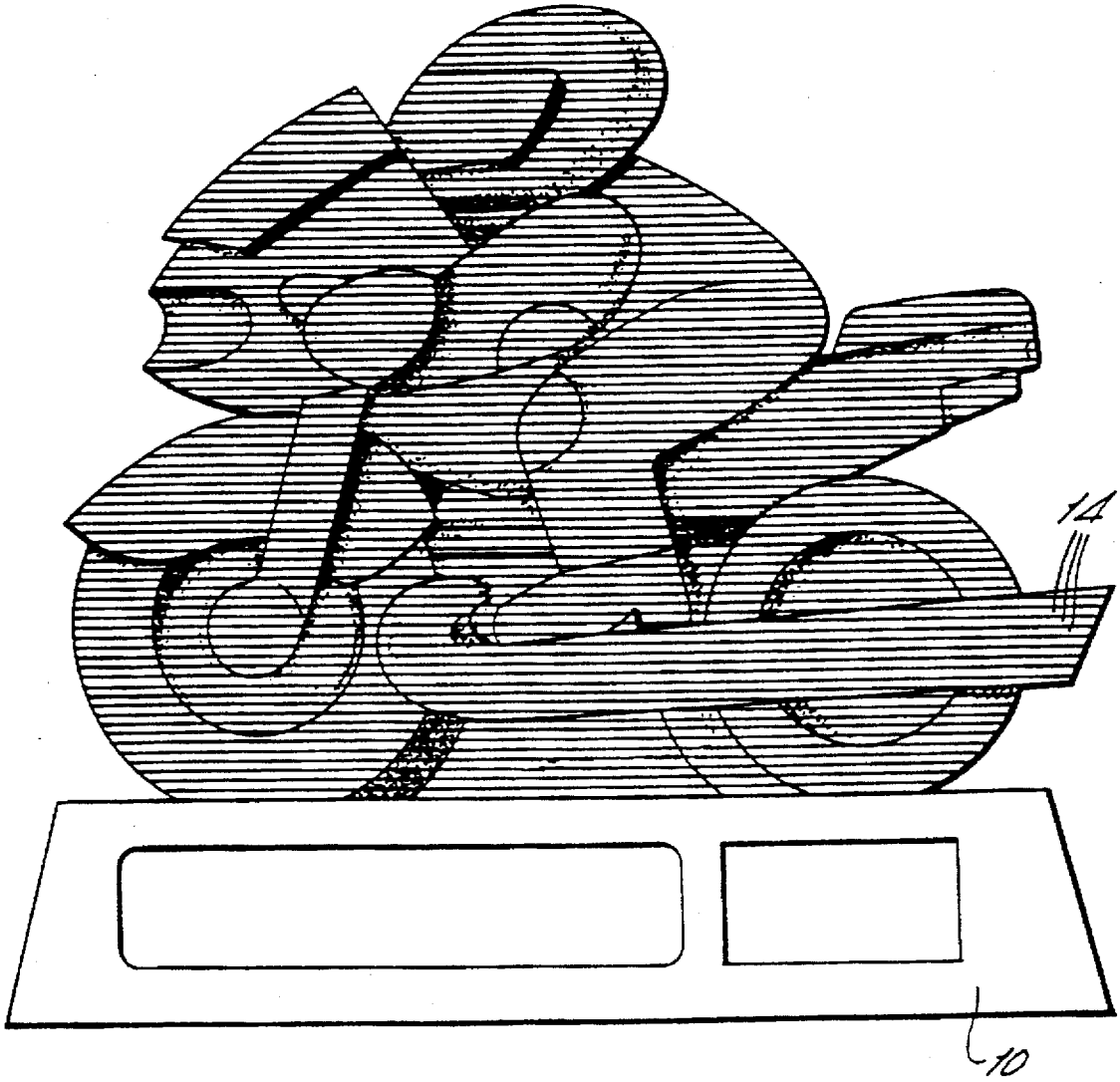
FIG. 2 shows another example of a completed sculpture puzzle according to the present invention.

Referring now to the drawings, FIGS. 1 and 2 illustrate two typical sculpture puzzles, of a rocket and a motorcycle and rider, respectively, as they might appear once the puzzle has been properly 'solved'.

In each case, the sculpture puzzles includes a number of elements. The lower portion of the sculpture puzzle is a base assembly 10 which can take on various configurations, as described in more detail below. The function of base assembly 10, as that term is used herein, is to retain the segments of the puzzle so as to prevent them from inadvertently sliding off the bottom end of the main core member, as described below. Base assembly 10 may be made of any suitable material including, but not limited to, plastic, metal, wood, cardboard, and the like.

Associated with base assembly 10 is one or more main core members which are generally not visible once the puzzle has been completed. A single main core member 12 is shown in broken lines in FIG. 1. The bottom end of main core member 12 is suitably attached to, or integrally formed with, base assembly 10. The function and possible configurations of main core member 12 and core members, in general, is described in more detail below. Main core member 12 may be made of any suitable material including, but not limited to, plastic, metal, wood, cardboard, and the like.

A sculpture puzzle of the present invention further includes a number of substantially planar segments 14. Segments 14 are formed with an opening therethrough which is dimensioned to slidably accommodate main core member 12. When segments 12 are mounted onto main core through its open top end member 12 in a correct sequence a three dimensional figure is formed, such as those shown in FIGS. 1 and 2.

Segments 14 may be made of any suitable material including, but not limited to, plastic, metal, wood, cardboard, and the like. Segments 14 may all be of the same thickness or they may have different thicknesses. Segments 12 may be colored or printed, especially on their edges so that the three dimensional figure is colored. The coloring of segments 14 may also make it easier for the user to put together the puzzle in a correct sequence. To make the puzzle easier to solve, some or all of segments 14 may feature writings, such as numerals, which help the user correctly create the three dimensional figure.

Each segment 14 may be symmetrical about main core member 12. Preferably, at least some, and more preferably, most of segments 14 are asymmetrical so that each of these segments must be mounted onto main core member 14 not only in the correct sequence but also with the proper lateral orientation.

Preferably, there is no limitation on the size, as measured, for example, by the surface area, of a specific segment and the size of an adjacent segment so that it is entirely possible, for example, for a first segment to have a smaller surface area than an adjacent segment which located between the first segment and the base assembly. Thus, the sequence of segments is not monotonic and succeeding segments may have various sizes and shapes regardless of the sizes and shapes of the adjacent segments.

Because segments 14 are substantially planar, contact between adjacent segments 14 is along a plane. As can be seen from FIGS. 1 and 2, various features of the three dimensional figures are formed by a number of segments 14. For example, each of the wings of the rocket of FIG. 1 is formed of portions of ten or more segments 14.

Figure 3:
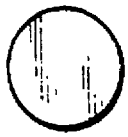
FIGS. 3–7 show a number of examples of cores which may be employed in sculpture puzzles according to the present invention.
Figure 4:
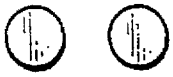
Figure 5:
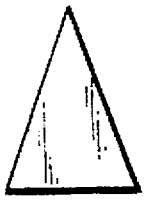
Figure 6:
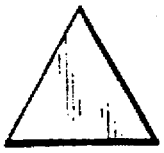
Figure 7:
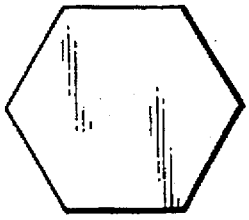

One or more main core members 12 of various shapes over at least a part of core member 12 may be used. Shown in cross-section FIGS. 3–7 are various numbers and shapes of core members. It is to be understood that the segments include corresponding openings which fit over the core member(s). For example, FIG. 3 shows a single circular core member. Using a single circular core significantly complicates the 'solving' of the puzzle in that every segment can be placed on the core member in a virtually infinite number of lateral orientations. FIG. 4 shows a pair of core members which limits the possible orientations to two in the case the two members are of the same diameter. When the pair of members are of different diameters there is only a single possible lateral orientation, which considerably simplifies the solution of the puzzle. Another way to ensure that only a single lateral configuration is possible is shown in FIG. 5 which shows a triangular cross-section with one side being shorter than the others. When the triangle is equilateral (FIG. 6) three orientations are possible. Similarly, a regular hexagon (FIG. 7) accommodates six possible orientations.

Base assembly 10 may be formed in any one of a number of ways. Three possibilities are illustrated in FIGS. 8–10.

Figure 8:
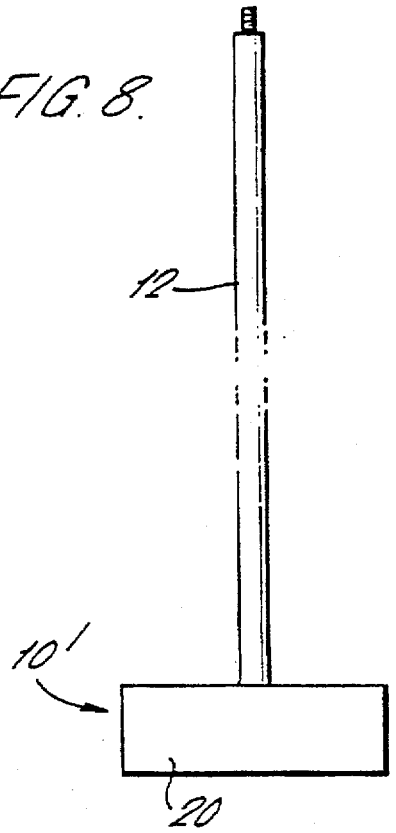
FIG. 8 illustrates one method of anchoring a core in sculpture puzzles according to the present invention.

In FIG. 8, base assembly 10' includes a base member 20 to which main core member(s) 12 is(are) permanently connected in any suitable fashion. Alternatively, main core member(s) 12 may be integrally formed with base member 20.

Figure 9:
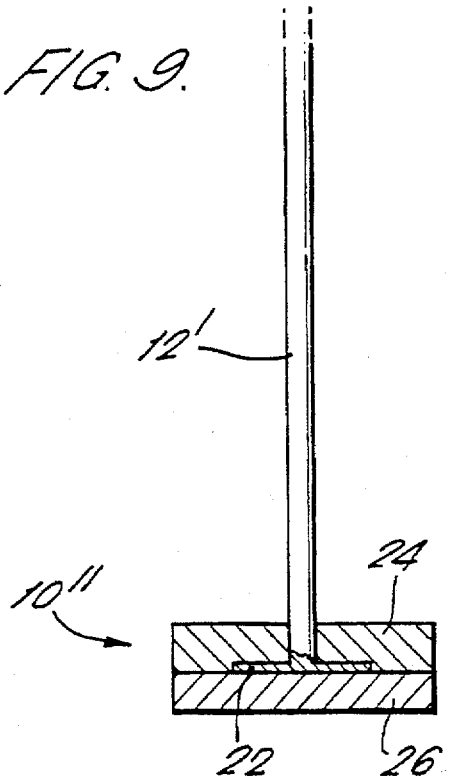
FIG. 9 illustrates a second method of anchoring a core in sculpture puzzles according to the present invention.

Shown in FIG. 9 is another base assembly 10" wherein main core member 12' features a thin broadened anchoring element 22 at its bottom end. Base assembly 10" includes at least a pair of sections 24 and 26 which are connected to each other by some suitable manner, such as, for example, through use of a suitable adhesive, so that one of each of sections 24 is on each side of anchoring element 22. Section 24 features an opening for accommodating core member 12 while section 26 is preferably without such as opening.

Figure 10:
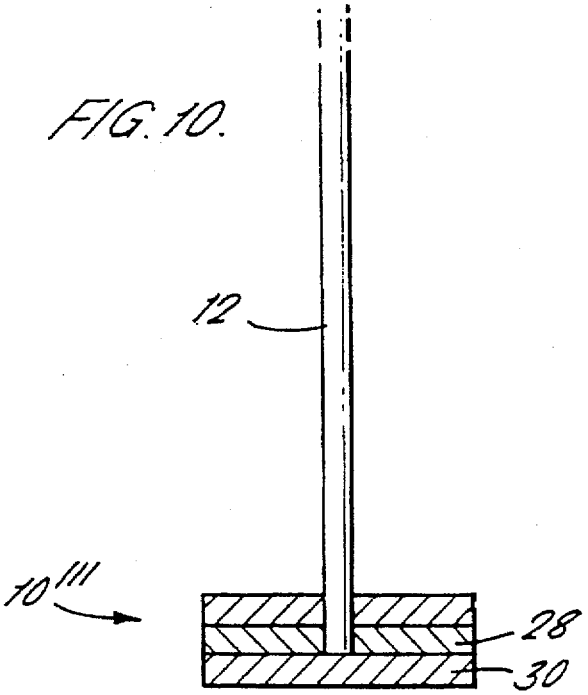
FIG. 10 illustrates a third method of anchoring a core in sculpture puzzles according to the present invention.

Shown in FIG. 10 is another base assembly 10'''. Base assembly 10''' includes at least a pair of sections 28 and 30 which are connected to each other by some suitable manner, such as, for example, through use of a suitable adhesive. Section 28 features an opening for accommodating core member 12 while section 30 is without such as opening so that core member 12 is supported at the bottom by section 30 while being supported at the sides by section 28 and any additional sections forming base assembly 10'''.

Preferably, a sculpture puzzle according to the present invention further includes a suitable closure member (40 in FIG. 1) for attaching to the top end of main core member 12. Closure member 40 serves to secure segments 14 on main core member 12 so as to prevent the inadvertent removal of segments 14 from main core member 12.

Various mechanisms may be envisioned for closure member 40, including, but not limited to, the screwing of a threaded closure member 40 onto a threaded top portion of main core member 12, the snapping or pressure fitting of closure member 40 onto the top of main core member 12, and the like. Closure member 40 may be a distinct and separate unit or it may be identical with, or very similar to one of the segments. For example, the segment placed last could have a number of protrusions which extend inwardly from the periphery of the opening of the segment such once the segment is pressed on the core member, the protrusions tend retain the segment in place.

For some three dimensional figures it is advantageous to make use of one or more auxiliary core members in order to express features which would otherwise be difficult or impossible to express using main core members. For example, as will be readily appreciated, the upper part of the motorcycle visor and the upper part of the rear luggage compartment of the motorcycle in FIG. 2 cannot be supported by a main core member which runs vertically through the main portion of the figure. To overcome this limitation, and to provide the device with a greatly enhanced versatility in the formation of even very complicated figures, it is proposed to use one or more auxiliary core members.

Figure 12:
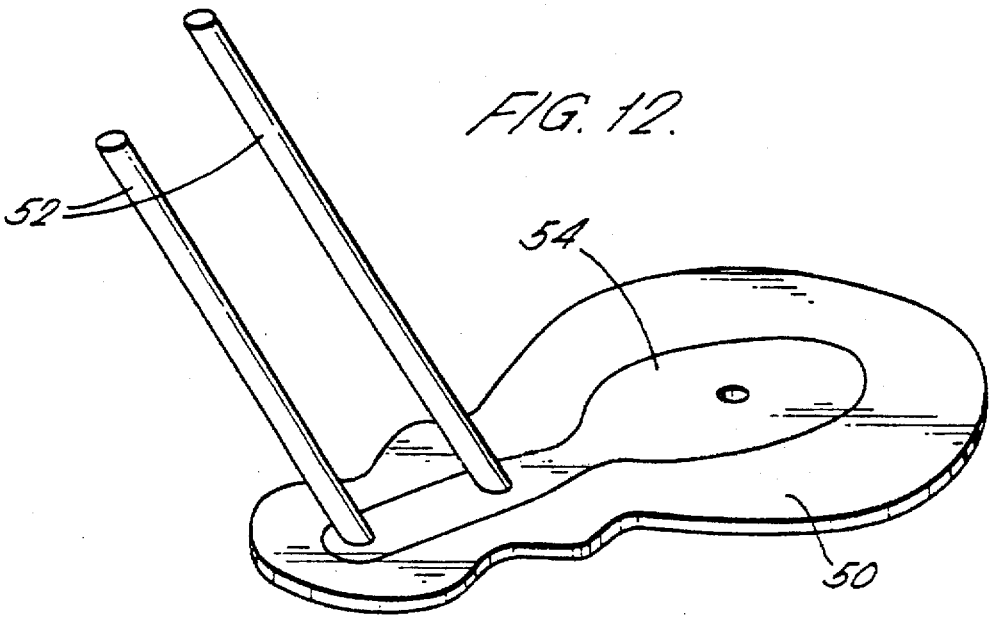
FIG. 12 is a perspective view of the auxiliary cores and their anchoring in an anchoring segment.
Figure 11:
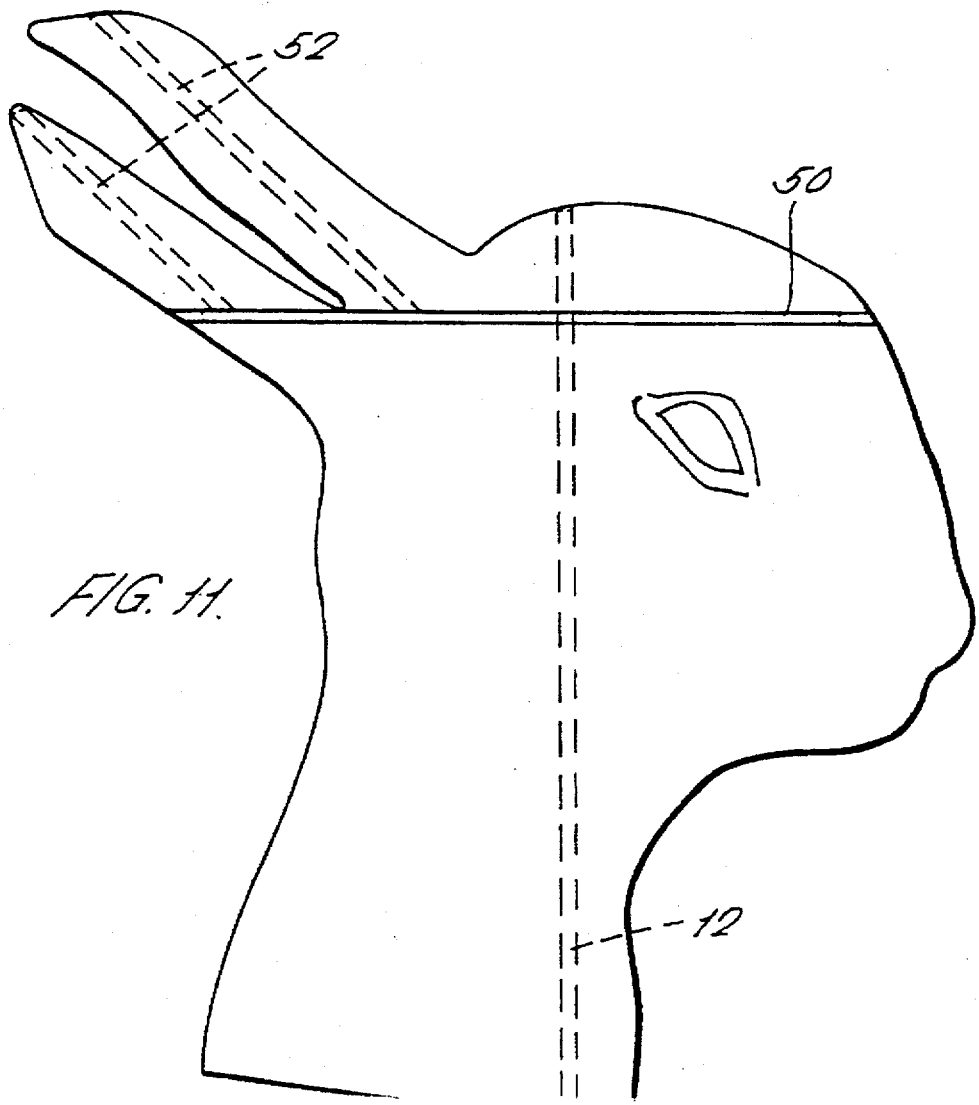
FIG. 11 shows another example of a sculpture puzzle according to the present invention featuring auxiliary cores.

The principle of an auxiliary core member is illustrated in FIGS. 11 and 12. FIG. 11 shows a portion of a figure (a rabbit's head) featuring a main core member 12. Shown in FIG. 11 is a special segment 50 which anchors a pair of auxiliary core members 52. Once special segment 50 is placed over main core member 12, auxiliary core members 52 can be used to place additional segments which are not mounted over main core member 12. Auxiliary core member 52 can be made from the same material as main core member 12 or from different materials.

Special segment 50 may feature an anchoring layer 54, such as a thin metal layer, to which auxiliary segments 52 are suitable attached. Alternatively, auxiliary core members 52 may be anchored using the techniques described with reference to FIGS. 8–10 with regard to the anchoring of main core member 12 or 12'.

It is to be noted from FIGS. 11 and 12 that auxiliary core members 52 need not be oriented in the same direction as main core member 12, further enhancing the versatility of the structure.

To create a three dimensional figure, the user would sequentially mount segments in the proper order and, where appropriate, orientation onto the main core member and any auxiliary core members. If a mistake is made so that either a wrong segment is mounted or a correct segment is mounted but in the wrong orientation, the user would remove the segments which were placed subsequently and would correct the mistake before continuing. Provided that all the segments are mounted in a correct sequence and, where appropriate, correct orientation, the desired three dimensional figure is produced.

Figure 13:
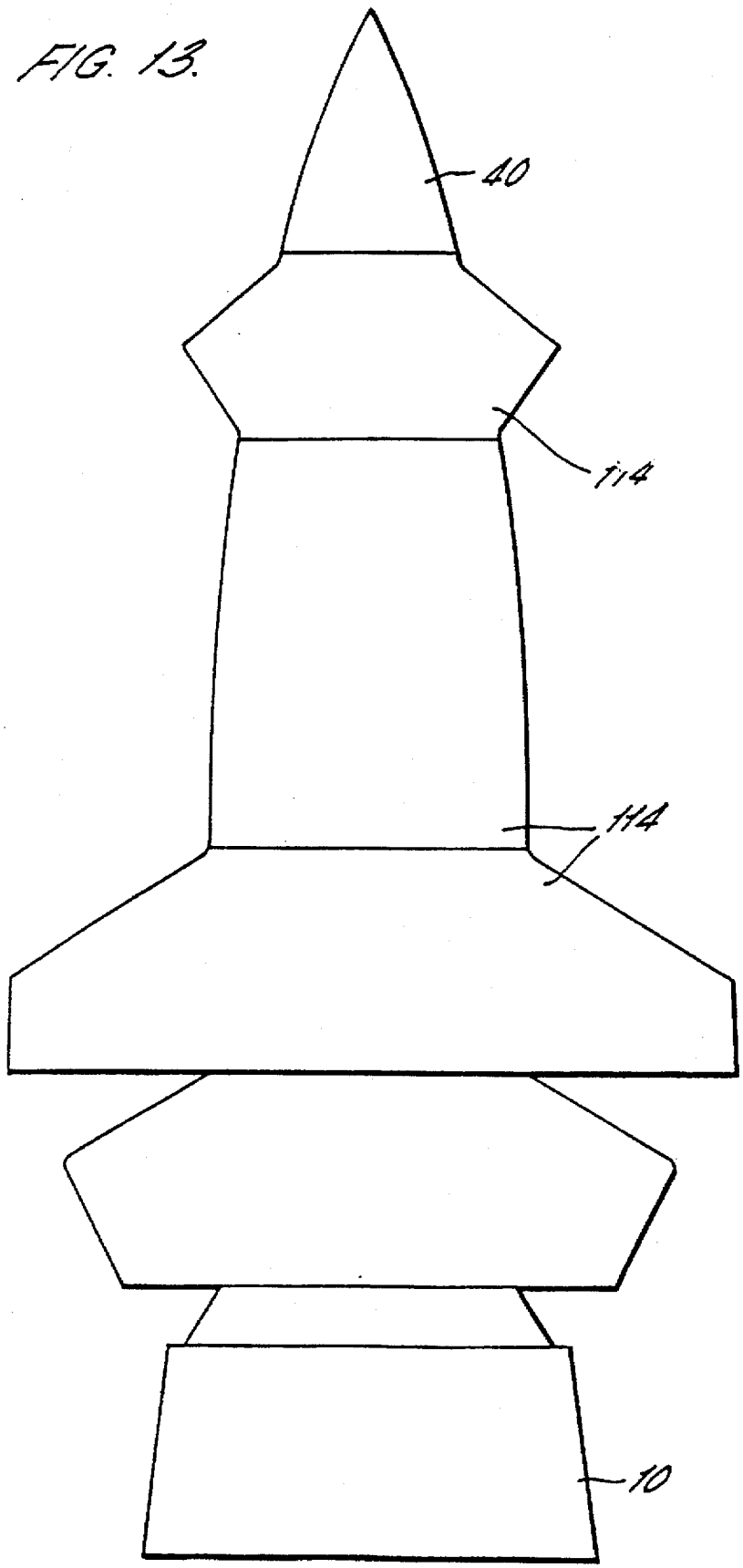
FIG. 13 shows another example of a completed sculpture puzzle according to the present invention made of a relatively small number of segments.

In one alternative embodiment of the present invention shown in FIG. 13, especially suitable for beginning users and/or children, segments 114 are relatively large so that each segment 114 may include a number of features. Because the puzzle is made up of relatively few segments 114, each of which is easily distinguishable from the others, the puzzle is considerably easier to solve.

Figure 14:
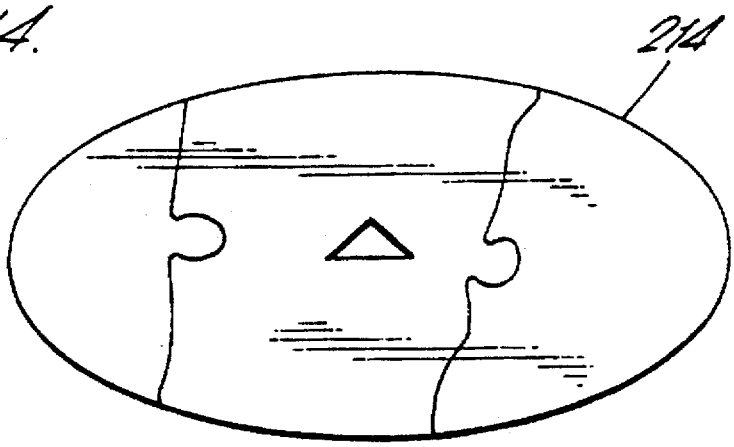
FIG. 14 shows a composite segment according to the present invention made up of a number of smaller interconnected sections.
Figure 15:
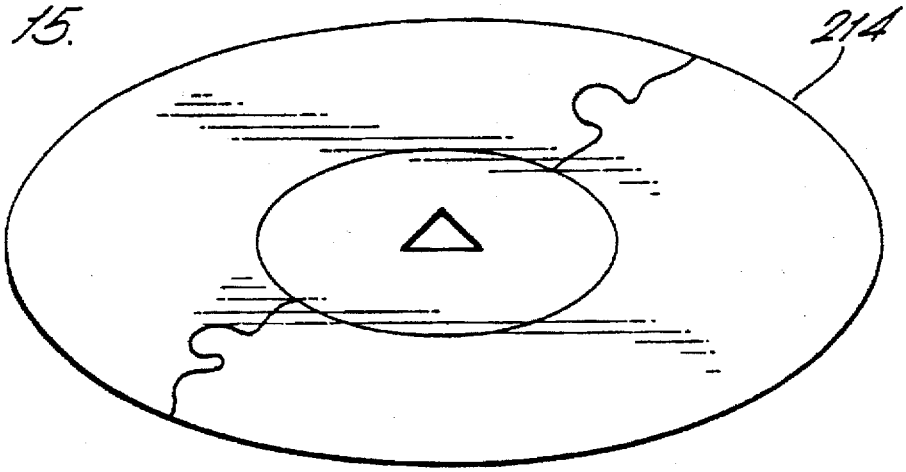
FIG. 15 another composite segment.
Figure 16:
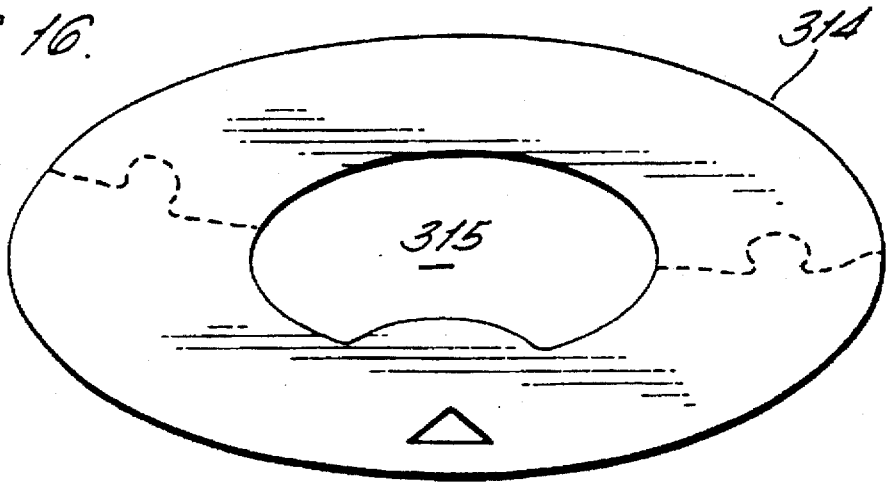
FIG. 16 shows a segment which includes a hollowed out portion.

Shown in FIGS. 14, 15 and 16 are examples of further alternative embodiment of the present invention. In FIG. 14, segment 214 is made up of a plurality of sections which are connectible with each other in the manner of conventional two-dimensional jigsaw puzzles to form the overall composite segment 214. Thus, prior to inserting the segments over the core, each composite segment 214 is first assembled from two or more pieces (three are shown in FIG. 14) in jigsaw fashion. The completed composite segment 214 is then placed over the core, as described above. Alternatively, composite segment 214 may be assembled or fully assembled only after the portion of composite segment 214 bearing the opening is placed over the core.

A portion of the periphery of the section of composite segment 214 which includes the opening for insertion over the core may partially define the periphery of composite segment 214, as in FIG. 14 or, alternatively, the section which includes the opening may be an interior section such that no portion of its periphery coincides with the periphery of composite segment 214, as in FIG. 15.

Shown in FIG. 16 is a segment 314, which may or may not be composite (as indicated by the broken line) which is not a solid disc but which, instead, features an internal cutout 315 so that, when the sculpture is assembled, it contains a hollowed out volume. The presence of cutout 315 reduces the weight of the discs and sculpture and may reduce the manufacturing costs through a reduction in the material costs. In addition, the hollowed out volume may be used for storage, if desired.

While the invention has been described with respect to a limited number of embodiments, it will be appreciated that many variations, modifications and other applications of the invention may be made.

What is claimed is:

1. A sculpture puzzle, comprising:

(a) a base assembly;

(b) at least one main core member having a main core top end and a main core bottom end, said main core bottom end being anchored to said base assembly;

(c) a plurality of substantially planar segments formed with an opening therethrough; and (d) at least one auxiliary core member having an auxiliary core bottom end and an auxiliary core top end, said auxiliary core bottom end being anchored to an auxiliary core base assembly, said auxiliary core base assembly including a first section and a second section, said second section being at least one of said planar segments formed with an opening therethrough for slidably accommodating said at least one auxiliary core and said first section being another of said planar segments which is solid so as to support said bottom end of said at least one auxiliary core member, said segments forming a three dimensional figure when slidably mounted in a proper order through said opening onto at least one of said at least one main core members and said at least one auxiliary core members through said main core top end and said auxiliary core top end, respectively.

2. The puzzle of claim 1, wherein at least one of said planar segments is a composite segment made up of a plurality of interconnected sections, at least one of said sections formed with said opening therethrough.

3. The puzzle of claim 2, wherein at least a portion of the periphery of said at least one section formed with said opening forms a portion of the periphery of said composite segment.

4. The puzzle of claim 2, wherein the periphery of said at least one section formed with said opening is interior to the periphery of said composite segment.

5. The puzzle of claim 1, wherein at least one of said planar segments includes an internal cutout.

6. The puzzle of claim 2, wherein at least one of said composite segments includes an internal cutout.

7. The puzzle of claim 1, wherein at least one of said segments has an area which is larger than an adjacent segment located between said at least one segment and said base assembly.

8. The puzzle of claim 1, wherein a plurality of said segments together form a feature of said three dimensional figure.

9. The puzzle of claim 1, wherein at least one of said segments forms a plurality of features of said three dimensional figure.

10. The puzzle of claim 1, wherein said at least one main core member is a single main core member.

11. The puzzle of claim 10, wherein said single main core member is substantially circular in cross-section over at least part of its length.

12. The puzzle of claim 10, wherein said single main core member is polygonal in cross-section over at least part of its length.

13. The puzzle of claim 12, wherein said single main core member is a regular polygon in cross-section over at least part of its length.

14. The puzzle of claim 1, wherein said at least one main core member is a pair of main core members.

15. The puzzle of claim 1, wherein said base assembly includes a base member to which said at least one main core member is permanently connected.

16. The puzzle of claim 1, wherein said base assembly includes a base member which is integrally formed with said at least one main core member.

17. The puzzle of claim 1, wherein said at least one main core member includes a broadened anchoring element at said bottom end of said at least one core member and wherein said base assembly includes at least a pair of sections which are connected to each other with one of each of said sections being on each side of said anchoring element.

18. The puzzle of claim 1, further comprising a closure member for attaching to said top end of said at least one main core member, said closure member serving to secure said segments on said at least one main core member.

19. The puzzle of claim 18, wherein said top end of said at least one main core member and said closure member are threaded so as to allow said closure member to screw onto said at least one main core member.

20. The puzzle of claim 18, wherein said closure member is designed to snap onto said top end of said at least one main core member.

21. The puzzle of claim 20, wherein said closure member is designed to pressure-fit onto said top end of said at least one main core member.

22. A method for creating a three dimensional figure, comprising the steps of:

(a) providing:

(i) a base assembly;

(ii) at least one main core member having a main core top end and a main core bottom end, said main core bottom end being anchored to said base assembly;

(iii) a plurality of substantially planar segments formed with an opening therethrough for slidably accommodating said at least one main core member; and (iv) at least one auxiliary core member having an auxiliary core bottom end and an auxiliary core top end, said auxiliary core bottom end being anchored to an auxiliary core base assembly, said auxiliary core base assembly including a first section and a second section, said second section being at least one of said planar segments formed with an opening therethrough for slidably accommodating said at least one auxiliary core and said first section being another of said planar segments which is solid so as to support said bottom end of said at least one auxiliary core member; and (b) mounting said segments in a proper order onto at least one of said at least one main core member and said at least one auxiliary core member, through said main core top end and through said auxiliary core top end, respectively, so as to form the three dimensional figure.

23. A sculpture puzzle, comprising:

(a) a base assembly;

(b) at least one main core member having a main core top end and a main core bottom end, said main core bottom end being anchored to said base assembly;

(c) at least one auxiliary core member having an auxiliary core member top end and an auxiliary member bottom end, said at least one auxiliary core member being non-parallel to said at least one main core member, said auxiliary core bottom end being anchored to an auxiliary core base assembly, said auxiliary core base assembly including a first section and a second section, said second section being at least one of said planar segments formed with an opening therethrough for slidably accommodating said at least one auxiliary core and said first section being another of said planar segments which is solid so as to support said bottom end of said at least one auxiliary core member; and (d) a plurality of substantially planar segments formed with an opening therethrough for slidably accommodating at least one of said at least one main core member and said at least one auxiliary core member, said segments forming a three dimensional figure when mounted in a proper order through said opening onto said at least one of said at least one main core members through said main core top end and at least one auxiliary core member through said auxiliary core top end, respectively.

24. The puzzle of claim 23, wherein at least one of said planar segments is a composite segment made up of a plurality of interconnected sections, at least one of said sections formed with said opening therethrough.

25. The puzzle of claim 24, wherein at least a portion of the periphery of said at least one section formed with said opening forms a portion of the periphery of said composite segment.

26. The puzzle of claim 24, wherein the periphery of said at least one section formed with said opening is interior to the periphery of said composite segment.

27. The puzzle of claim 23, wherein at least one of said planar segments includes an internal cutout.

28. The puzzle of claim 24, wherein at least one of said composite segments includes an internal cutout.

29. The puzzle of claim 23, wherein said at least one main core member is a pair of main core members.

30. A method for creating a three dimensional figure, comprising the steps of:

(a) providing:

(i) a base assembly;

(ii) at least one main core member having a main core top end and a main core bottom end, said main core bottom end being anchored to said base assembly;

(iii) at least one auxiliary core member having auxiliary core top end and an auxiliary core bottom end, said at least one auxiliary core member being non-parallel to said at least one main core member, said auxiliary core bottom end being anchored to an auxiliary core base assembly, said auxiliary core base assembly including a first section and a second section, said second section being at least one of said planar segments formed with an opening therethrough for slidably accommodating said at least one auxiliary core and said first section being another of said planar segments which is solid so as to support said bottom end of said at least one auxiliary core member; and (iv) a plurality of substantially planar segments formed with an opening therethrough for slidably accommodating at least one of said at least one main core members or said at least one auxiliary core members, as appropriate; and (b) mounting said segments in a proper order onto at least one of said at least one main core member and said at least one auxiliary core member, as appropriate, through said main core top end and through said auxiliary core top end, respectively, so as to form a three dimensional figure.

* * * * *